United States Patent [19]

Hauke

[11] Patent Number: 4,887,661

[45] Date of Patent: Dec. 19, 1989

[54] CASTING MOLD FOR FOUNDRY CASTINGS

[75] Inventor: Wilhelm Hauke, Hilzingen, Fed. Rep. of Germany

[73] Assignee: Georg Fischer AG, Schaffhausen, Switzerland

[21] Appl. No.: 307,674

[22] Filed: Feb. 6, 1989

[30] Foreign Application Priority Data

Feb. 5, 1988 [CH] Switzerland ..... 423/88

[51] Int. Cl.[4] ..... B22D 27/00

[52] U.S. Cl. ..... 164/55.1; 164/134; 164/349; 164/362

[58] Field of Search ..... 164/55.1, 56.1, 57.1, 164/58.1, 133, 134, 349, 358, 362, 364

[56] References Cited

U.S. PATENT DOCUMENTS

| | | | |
|---|---|---|---|
| 967,012 | 8/1910 | Casche et al. | 164/362 |
| 2,096,707 | 10/1937 | Campbell | 164/358 |
| 3,680,628 | 8/1972 | McLean | 164/362 |
| 4,037,643 | 7/1977 | Mohla et al. | 164/349 |
| 4,749,022 | 6/1988 | Jeanneret | 164/358 |

*Primary Examiner*—Richard K. Seidel

*Attorney, Agent, or Firm*—Bachman & LaPointe

[57] ABSTRACT

A casting mold for foundry castings is proposed wherein the casting mold comprises a melt treatment chamber above a mold cavity wherein the treatment chamber and mold cavity are communicated via a duct. The treatment chamber is provided with a closure element formed as part of the casting mold which is shearable therefrom upon the application of a force for sealing the duct between the treatment chamber of the mold cavity.

8 Claims, 2 Drawing Sheets

CASTING MOLD FOR FOUNDRY CASTINGS

BACKGROUND OF THE INVENTION

The present invention relates to a casting mold for foundry castings wherein treatment of the cast melt is carried out in a treatment chamber arranged in the casting mold wherein the treatment chamber is provided with an opening for an entry duct for passing the treated metal melt into a mold cavity of the casting mold.

The prior art is replete with proposals for casting molds which provide for a treatment chamber and/or reaction chamber for treating a melt prior to the introduction of the melt into the casting mold cavity. For example, U.K. Patent Application No. GB 2171941A, assigned to the assignee of the instant invention, discloses a casting mold which provides an open treatment chamber in the casting mold above the mold cavity. In the design of the casting mold of the U.K. application, a pouring duct is provided upstream of the mold cavity and forms the entrance for the melt to the mold cavity from the treatment chamber. The duct is opened and closed by means of a plug. The plug is made of graphite, ceramic or other uncombustible material. When the treatment of the molten melt in the open treatment is complete, the stopper is moved from its closed position to its opened position thereby allowing the liquid melt to flow from the treatment chamber through the duct into the mold cavity. The plug, which seals and unseals the duct of the mold cavity is designed to be used repeatedly.

The casting mold cavity of the present invention is an improvement over the casting mold described above. The object of the present invention is to provide a casting mold for foundry castings wherein the treatment of the melt is carried out in a casting mold which afords little chance of contamination of the melt and good economics.

SUMMARY OF THE INVENTION

The foregoing object is achieved by way of the present invention by providing a casting mold for use in foundry castings which comprises a treatment chamber formed in the casting mold above a mold cavity wherein a duct is provided between the treatment chamber and the mold cavity for selectively passing a melt from the treatment chamber to the mold cavity. In accordance with the particular feature of the present invention, a closing element for selectively sealing and unsealing the duct is located within the treatment chamber above and spaced from the entry duct and is formed as one piece with the casting mold and is shearable therefrom for closing the entry duct. In accordance with the present invention a ram is provided for applying a downward force on the closing element thereby shearing the closing element from the casting mold and biasing the closing element downward for sealing the entry duct located between the treatment chamber and the mold cavity. After the melt is treated in the treatment chamber with a treatment agent, the force of the ram is removed from the closing element thereby allowing the closing element to float upward in the melt thus uncovering and opening the duct so as to allow the treated melt material to pass from the treatment chamber and into the mold cavity.

The present invention further contemplates a process for producing castings employing the casting mold as set forth above.

Further objects and advantages of the present invention will appear hereinbelow.

DETAILED DESCRIPTION

Figure 1:
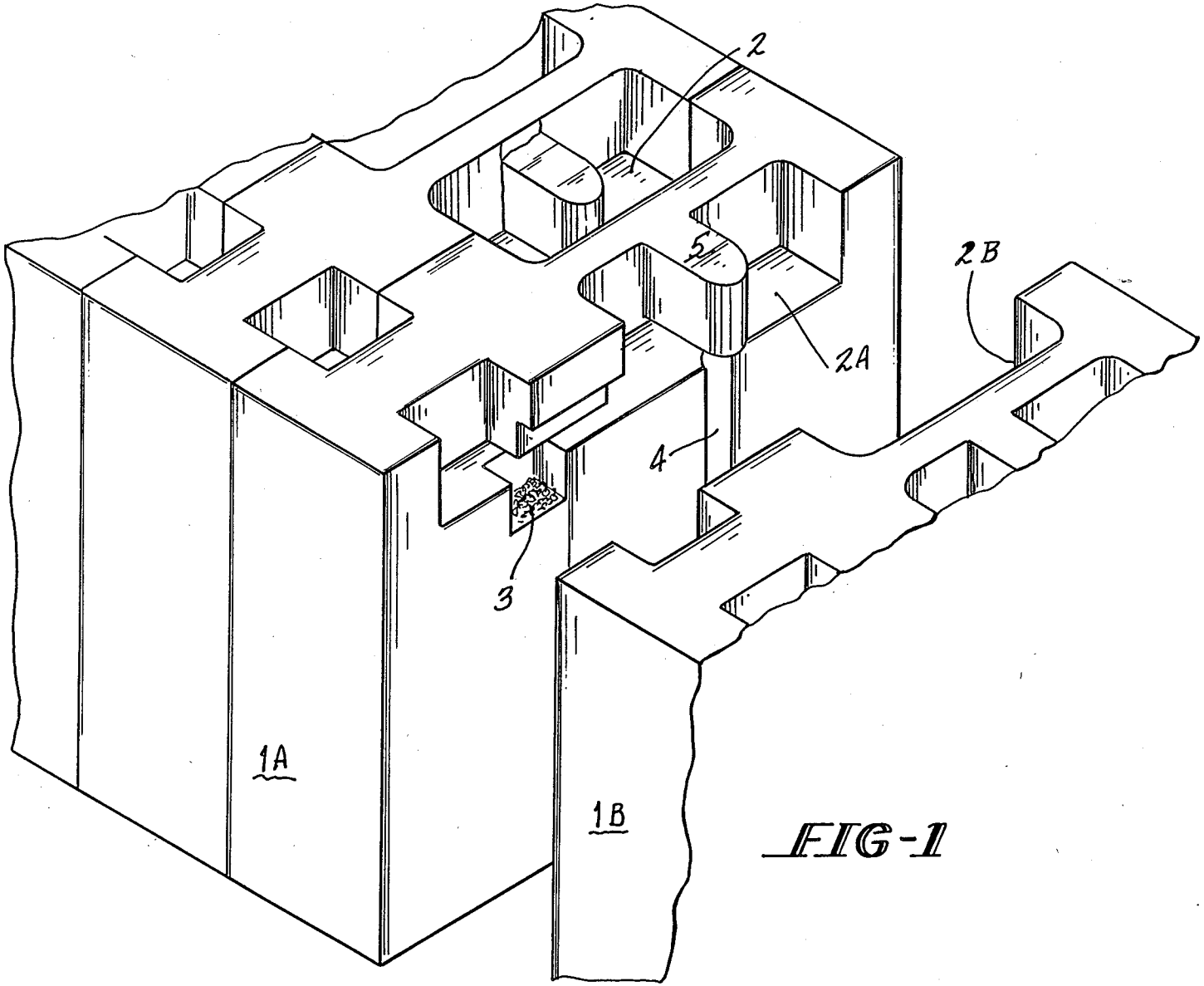
FIG. 1 is a perspective view of the casting mold arrangement in accordance with the present invention.

With reference to the drawings, FIG. 1 shows an arrangement comprising a plurality of casting molds used in foundry casting processes. As illustrated herein, the casting molds are sand molds and each comprise two halves, 1*a* and 1*b*, respectively. Each mold half 1*a*, 1*b* is provided with a recess 2*a* and 2*b* which together form a treatment chamber 2 when the mold halves have been brought together in their closed position.

A recess 3 is provided in the floor of the treatment chamber 2 for the purpose of holding the melt treatment agent used in the foundry casting process. Typical melt treatment agents used in the foundry casting process may include, for example, a drop-forming agent, for example, magnesium, calcium, lithium, strontium, barium, iron or alloys of these elements.

Figure 2:
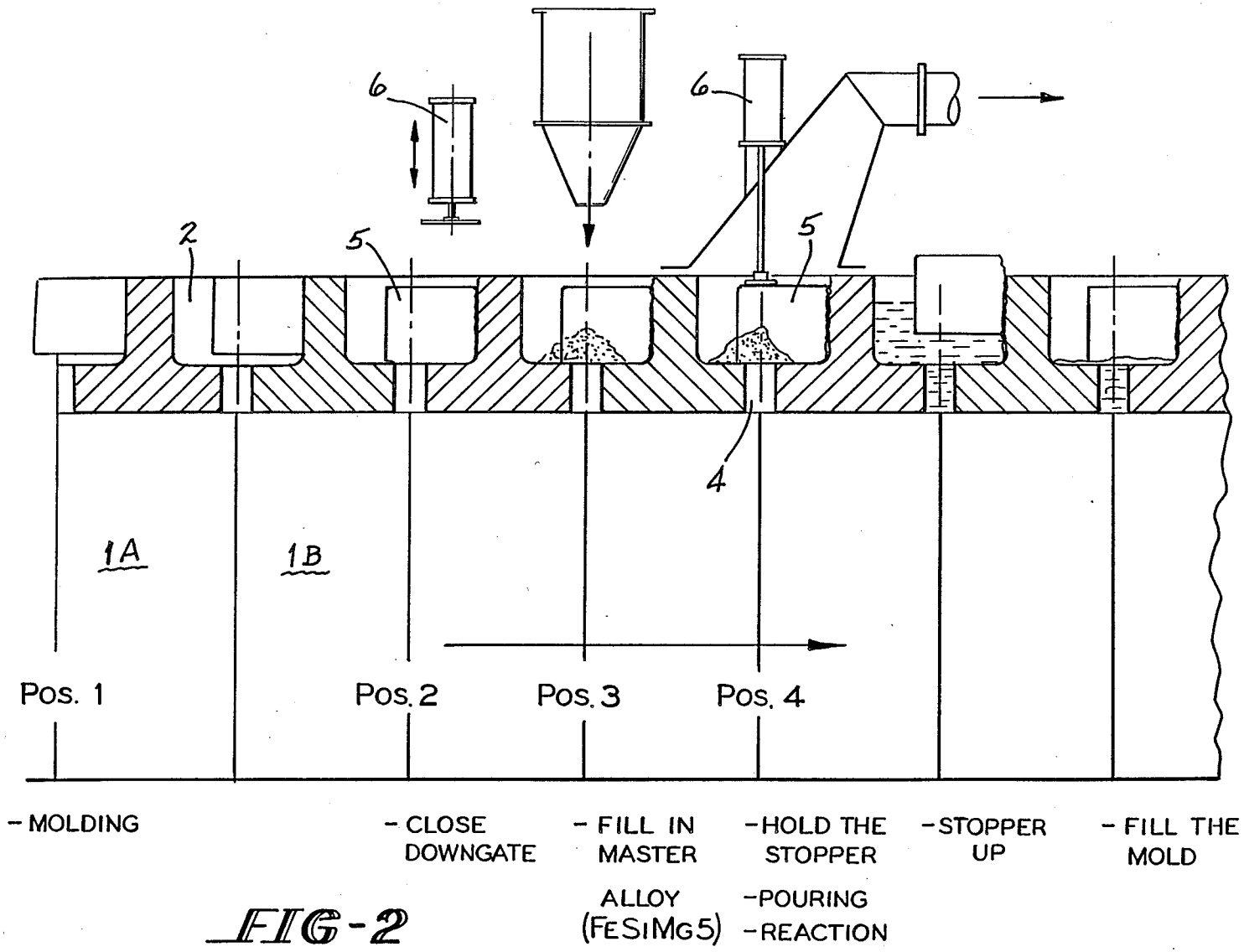
FIG. 2 illustrates the casting mold of FIG. 1 in different positions during the foundry casting process.

An entry duct 4 leads from treatment chamber 2 to a mold cavity (not shown) located beneath the treatment chamber. The entry duct communicates the treated melt from treatment chamber 2 to the mold cavity once melt treatment is completed in treatment chamber 2. A closing element 5 formed as part of the casting mold is provided over the entry duct and, as can be seen in FIG. 2, is spaced from said entry duct a small distance. The shape of the closing element is of no particular importance. What is essential is that the closing element be of a size and shape sufficient for covering the entire area of entry duct 4 so as to seal same. In practice, the shape of the closing element may be cylindrical or prism shaped. The closing element 5 preferably tapers in cross section in the direction of metal flow from the treatment chamber to the mold cavity. This reduction in cross section in the area results in a surface of the closing element increases surface area thereby allowing for a greater upward thrust as the melt acts on the closing element in a manner described hereinbelow. The closing element 5 performs the same function as the plug referred to above with regard to U.K. Patent Application No. GB 2171941A and will be described in greater detail with reference to FIG. 2 hereinbelow.

With reference to FIG. 2 there is illustrated a casting mold according to the present invention in its various positions during filling, treatment and casting into a mold cavity. As noted above, the casting mold comprises the mold halves 1*a* and 1*b* which, in position 1, are shown in their closed position. In position 2 a ram 6 is provided for applying a force to closing element 5 for shearing closing element 5 from the casting mold 1 and biasing the closing element 5 downward so as to close entry duct 4 and seal same tightly. Position 3 of FIG. 2 shows recess 3 of the treatment chamber 2 being filled with the treatment material, for example, an FeSiMg alloy. In position 4, with the closing element held in place for sealing entry duct 4, the treatment chamber is filled with liquid molten metal. The closing element 5 is held in position for such time as is necessary to allow for the complete treatment of the melt in treatment chamber 2. After the melt treatment is completed the downward force exerted on the closing element 5 is removed whereby the closing element floats upwardly as a result of the upward force of the melt on the closing element thereby opening the entry duct 4 and allowing the treated melt to pass from the treatment chamber 2 via entry duct 4 into the mold cavity. After solidification of the casting is complete in the mold cavity, the casting can be removed therefrom and the closing element can be taken with the rest of the sand casting mold material for reprocessing.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A casting mold for use in foundry castings comprising:

a treatment chamber formed in the casting mold above a mold chamber;

an entry duct communicating said treatment chamber with said mold cavity for passing a melt from said treatment chamber to said mold cavity; and closing means located within said treatment chamber above and spaced from said entry duct, said closing means being formed as one piece with said casting mold and shearable therefrom for closing said entry duct.

2. A casting mold according to claim 1 wherein said closing means is sheared from said casting mold upon the application of a downward force to said closing means.

3. A casting mold according to claim 2 including ram means for applying said downward force to said closing means for shearing said closing means from said casting mold and sealing said closing means on said entry duct.

4. A casting mold according to claim 1 wherein said casting mold is a sand mold.

5. A casting mold according to claim 1 wherein said closing means is in the shape of a cylinder.

6. A casting mold according to claim 1 wherein said closing means is in the shape of a prism.

7. A casting mold according to claim 1 wherein the closing means is provided with one load bearing surface for an accelerated upthrust.

8. A process for the production of castings in a casting mold having a melt treatment chamber located above a mold cavity and in communication therewith via an entry duct for passing the melt from the treatment chamber to the melt cavity, the improvement comprising the steps of:

providing a duct closing element in said treatment chamber above said entry duct and forming said closing element as a piece of said casting mold;

applying a force to said closing element for shearing said closing element from said casting mold and biasing said closing element against said entry duct for sealing same;

positioning a treatment agent in said treatment chamber;

pouring said melt into said treatment chamber while maintaining said closing element in sealing engagement with said entry duct; and thereafter removing said force from said closing element whereby said closing element floats upward in said melt thereby unsealing said entry duct so as to allow said melt to flow from said treatment chamber through said duct and into said mold cavity.

* * * * *